US007146940B2

(12) United States Patent
Knutsen

(10) Patent No.: US 7,146,940 B2
(45) Date of Patent: Dec. 12, 2006

(54) COMBUSTION ENGINE

(75) Inventor: Magnus Knutsen, Kungsbacka (SE)

(73) Assignee: Currency Venture Sweden Aktiebolag (SE)

( * ) Notice: Subject to any disclaimer, the term of this patent is extended or adjusted under 35 U.S.C. 154(b) by 0 days.

(21) Appl. No.: 10/472,574

(22) PCT Filed: Apr. 2, 2002

(86) PCT No.: PCT/SE02/00639

§ 371 (c)(1),
(2), (4) Date: Sep. 25, 2003

(87) PCT Pub. No.: WO02/081886

PCT Pub. Date: Oct. 17, 2002

(65) Prior Publication Data

US 2004/0112311 A1 Jun. 17, 2004

(30) Foreign Application Priority Data

Apr. 3, 2001 (SE) ..... 0101180

(51) Int. Cl.
*F02D 15/04* (2006.01)

(52) U.S. Cl. ..... 123/48 B; 123/78 B

(58) Field of Classification Search ..... 123/48 A, 123/48 AA, 78 A, 78 AA, 78 B, 48 R–48 D, 123/78 R–78 F; 92/255–256, 215
See application file for complete search history.

(56) References Cited

U.S. PATENT DOCUMENTS 2,170,266 A * 8/1939 Leissner ..... 123/78 R
3,311,096 A * 3/1967 Carney et al. ..... 123/78 R
3,450,112 A * 6/1969 Bachle ..... 123/78 R
3,667,433 A * 6/1972 Isley ..... 123/78 B
3,704,695 A * 12/1972 Cronstedt ..... 123/78 B
4,016,841 A * 4/1977 Karaba et al. ..... 123/78 B
4,241,705 A * 12/1980 Karaba et al. ..... 123/78 B
5,755,192 A * 5/1998 Brevick ..... 123/78 B

* cited by examiner

*Primary Examiner*—Marguerite McMahon
(74) *Attorney, Agent, or Firm*—Joseph T. Leone, Esq.; DeWitt Ross & Stevens S.C.

(57) ABSTRACT

Disclosed is a combustion engine. The engine includes a combustion chamber (40), which is delimited at one end by a head (41) and delimited at a second end by a piston (1). The piston is arranged on a connecting rod (3) via a piston pin (2). A body (1;8;52) with a delimiting surface (8A) is movable in relation to the piston pin (2) and facilitates a variable volume in the combustion chamber (40). A compression spring (10), acts on the surface (8A) with a spring force in the direction of the combustion chamber (40). The engine further includes a pressure chamber (11) that can be supplied with hydraulic oil from a pressure source via a feed duct (12,13), which pressure chamber (11) is able to cause hydraulic movement of the moveable delimiting surface (8A) with the aim of being able to adjust the size of the combustion chamber depending on the combustion pressure. The pressure chamber (11) communicates with an inlet duct (13) that facilitates replenishment of the hydraulic oil from the pressure source to the pressure chamber (11) when the pressure (P2) in the pressure chamber (11) falls below the pressure (P1) in the feed duct (13).

21 Claims, 5 Drawing Sheets

COMBUSTION ENGINE

CROSS-REFERENCE TO RELATED APPLICATIONS

Priority is hereby claimed to International Application Serial No. PCT/SE02/00639 (International Publication no. WO 02/081886A1), filed 2 Apr. 2002, which International Application claims right of priority to Swedish Application Ser. No. 0101180-8, filed 3 Apr. 2001, the contents of both of which are incorporated herein by reference.

SPHERE OF THE INVENTION

The present invention relates to a combustion engine comprising at least one combustion chamber, which is delimited at one end by ahead and delimited at a second end by a piston, the piston being arranged by means of a piston pin on a connecting rod, a body with a delimiting surface that is movable in relation to the piston pin and facilitates a variable volume in said combustion chamber, a compression spring, which spring acts on said surface with a spring force in the direction of the combustion chamber, a pressure chamber that cam be supplied via a feed duct with hydraulic oil from a pressure source, which pressure chamber is intended by means of the hydraulic oil to be able to influence movement of said movable delimiting surface with the aim of being able to adjust the size of the combustion chamber depending on the combustion pressure. The engines in which the invention is intended to be used are in particular car engines of different types such as diesel engines and petrol engines and perhaps principally engines of this kind in which supercharging occurs.

PRIOR ART AND PROBLEM

Combustion engines for cars are well known. They occur in various versions but four-stroke engines of various types are the most dominant. What is common to all engines is that they comprise one or more cylinders in which a piston can move up and down and drive a crankshaft to which they are connected depending on the pressure in the combustion chamber, which pressure changes between a vacuum and a very high momentary pressure. The pistons are normally provided with a transverse so-called piston pin, around which the connecting rod is supported rotatably, which connecting rod is supported at its other end around the crankshaft and drives this. In the cylinder chamber is lubricating oil, which is pumped round at a pressure of 4–5 bar and lubricates all surfaces that slide against one another.

A combustion engine develops its driving energy in that a fuel-air mixture is aspirated or introduced through pressure into a fuel chamber above the piston, a spark igniting the fuel-air mixture that is quickly combusted and produces a high pressure that presses the piston down, the downward movement of which is converted into a rotary movement in the crankshaft. The power tapping of the engine is dependent to a very high degree on the composition of the fuel-air mixture and the pressure in this prior to ignition. When the fuel-air mixture is compressed by the upward movement of the piston, the temperature in this increases and there is a risk that the mixture shall be ignited before the spark appears and thereby produce an undesirable combustion process. This premature ignition is called knocking and can easily be heard outside the engine. This problem is particularly great in turbocharged engines in which the fuel-air mixture is forced in instead of being aspirated. To avoid knocking etc.

when feeding the fuel-air mixture, it is necessary to start out from an extremely low compression ratio. When driving a turbocharged car with low loading, for example, on normal main roads, there will be a vacuum in the inlet manifold. The vacuum and the fact that there is a low compression ratio in the engine from the outset means that the optimum combustion and economy that the fuel can actually provide are not obtained.

The ideal would be to have a compression pressure close to the knocking limit at all speeds and engine loads. Optimum combustion can thus be obtained in all conditions; a high compression ratio with low power tapping and a low ratio that permits turbocharging with high power tapping. This can be achieved with a variable compression chamber. It is previously known from DE 3714762 to use hydraulic adjustment to change/optimize the compression ratio during operation in such a manner. Claim 1 is delimited in relation to this immediately known art. DE 3714762, however, utilizes rigid hydraulic adjustment, i.e. adjustment that does not offer the possibility of automatic momentary adjustment of the compression ratio during operation. It is previously known from U.S. Pat. No. 4,286,552 to use a device that facilitates momentary adjustment, which is achieved by means of a spring that acts on the position of a movable delimiting surface of the piston depending on the counter pressure inside the combustion chamber. A solution according to U.S. Pat. No. 4,286,552 results in the great disadvantage, however, that in certain operating conditions unfavourable vibration can take place, which can lead to total destruction in the worst case. Thus such a solution is very difficult if not impossible to realize in practice.

Solution

According to the present invention, the aforementioned problems have been solved or at least minimized by making said pressure chamber communicate with an intake duct that always facilitates replenishment of hydraulic oil from said pressure source to the pressure chamber when the pressure in the pressure chamber falls below the pressure in the feed duct, and by providing said pressure channel with an outlet that communicates with at least one restricting device that continuously facilitates a flow of hydraulic oil out of the pressure chamber when the pressure in the pressure chamber exceeds the pressure in said outlet, so that damping of the movement of said body with said delimiting surface is obtained during operation.

DESCRIPTION OF DRAWINGS

The invention will be described below in greater detail with reference to the enclosed drawings, in which.

DETAILED DESCRIPTION OF THE INVENTION

Figure 1:
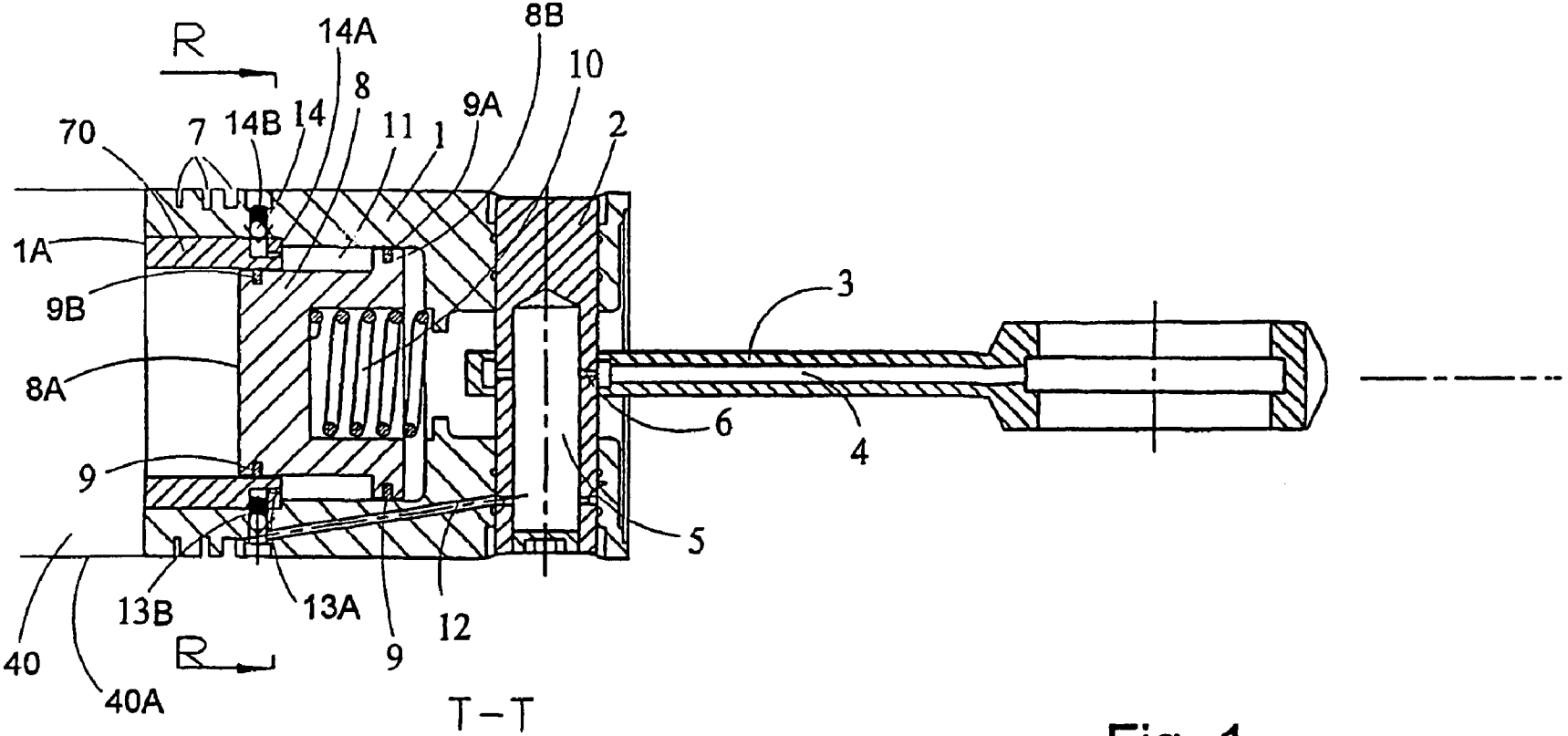
FIG. 1 shows a first embodiment of the invention in axial section.

FIG. 1 shows a piston 1 in a combustion engine in which a piston pin 2 is inserted by the lower part of the piston, around which pin a connecting rod 3 is fitted. These elements are known in themselves and are not described in greater detail. The connecting rod 3 has a continuous duct 4, through which oil under pressure flows into a cavity 5 in the piston pin 2. The pressure source for the oil is the engine's lubricating oil bath, which is normally pressurized to 4–5 bar during operation. A hole 6 is therefore included in the piston pin 2 so that the oil can flow into the piston pin 2. On the outside of the piston 1, by its upper end, grooves 7 are provided to receive the piston rings.

A recess has been made in the piston 1 from its upper side and arranged in this according to the present invention is a body/adjusting piston 8. This adjusting piston 8 is sealed at the bottom by lower seals 9A that seal it at the bottom against the cylindrical inside of said recess. At the top, the adjusting piston 8 is provided with a further seal 9B that seals it against the inside of a sleeve-shaped part 70 that is fixed at the top inside said recess. The adjusting piston 8 is provided with a recess on its lower side into which a helical spring 10 has been inserted. The spring 10 rests against the bottom of this recess and the bottom of the recess in the piston 1. This helical spring 10 thus strives to move the adjusting piston 8 to its upper position and the spring force in this helical spring 10 must be overcome by the combustion pressure for the adjusting piston 8 to be able to be pressed down. Arranged at the lower end of the adjusting piston is a flange 8B that supports the seals 9. An annular gap space is formed between the flange 8B of the adjusting piston and the sleeve-shaped body 70, which space forms a type of pressure chamber. This space/pressure chamber 11 is intended to hold oil for damping the movements of the adjusting piston 8 up and down. This oil is supplied to the pressure chamber 11 from the space 5 in the piston pin 2 via a duct 12 and a nonreturn valve 13B. For the outlet of oil from the space 11 (when a certain pressure is exceeded inside the space 11) there is an outlet 14 comprising a restricting device 14A and a nonreturn valve 14B. When the oil leaves the outlet 14, it flows out on the outside of the piston 1. When there is oil pressure in the engine, the space 11 will be filled with oil.

Figure 1A:
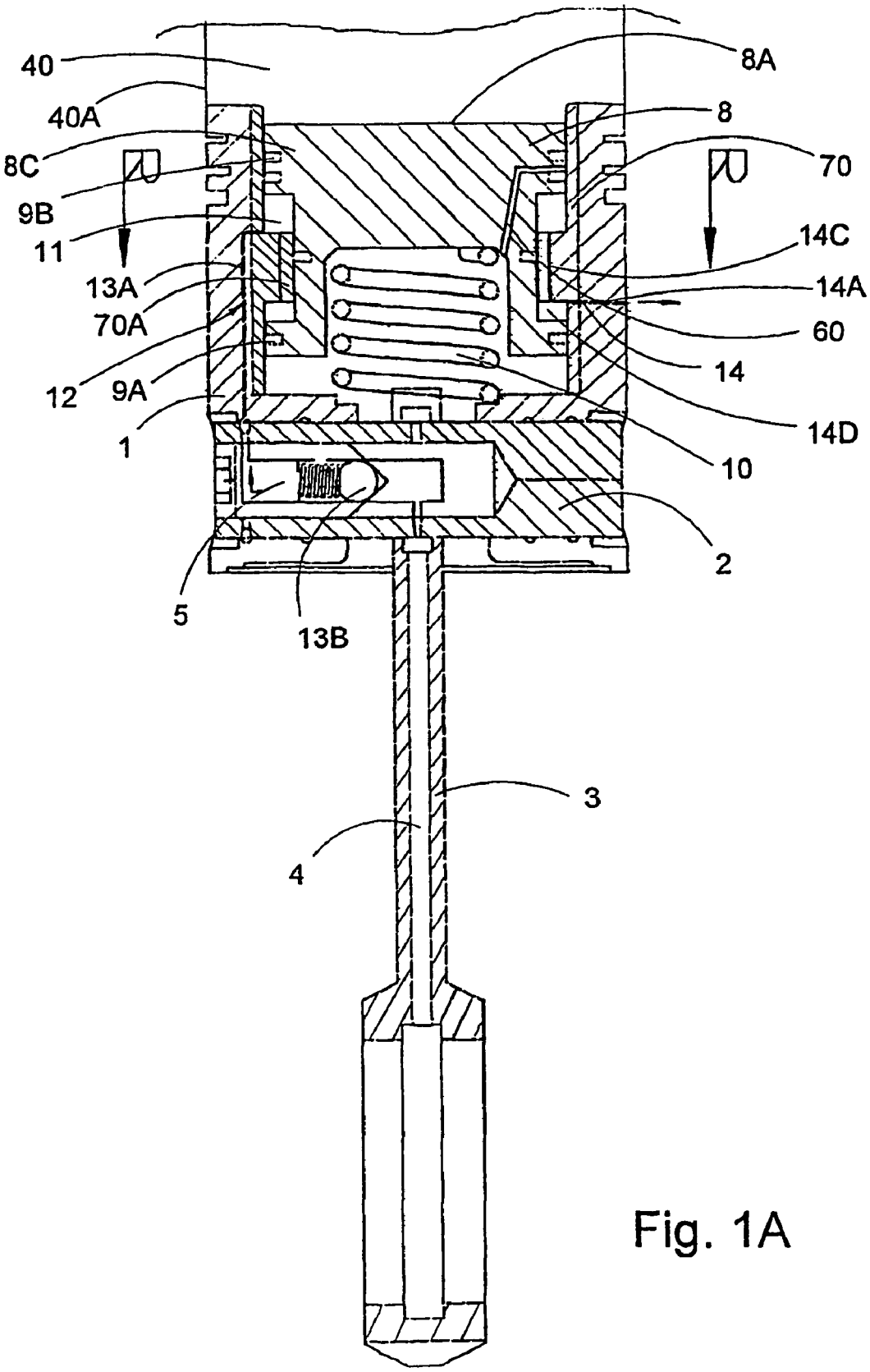
FIG. 1A shows an axial cross-section of a preferred embodiment.
Figure 1B:
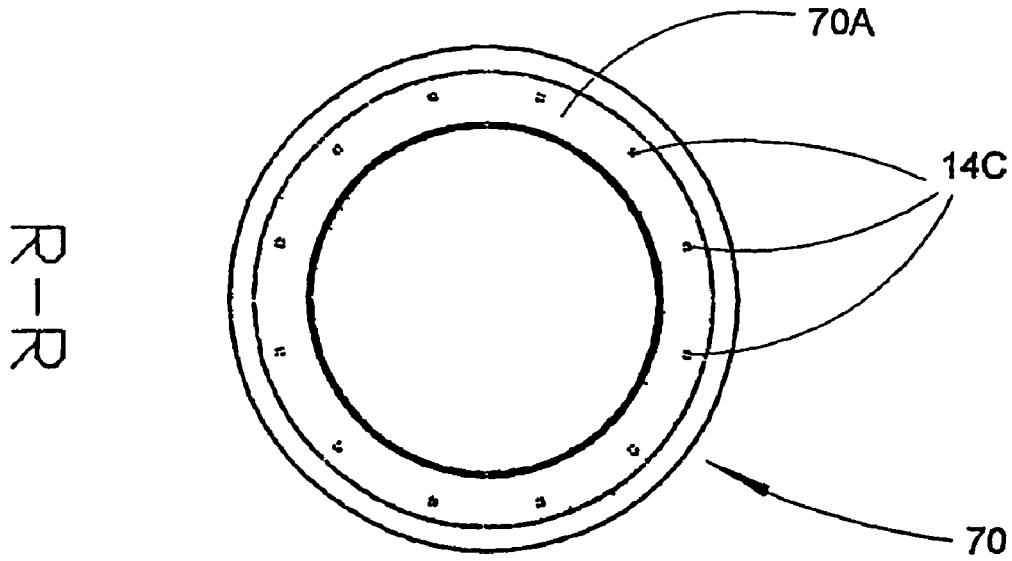
FIG. 1B shows a radial cross-section along R—R in FIG. 1A, FIG. 2, also in axial section, shows another embodiment of the present invention, and FIG. 3, also in axial section, shows a third embodiment of the present invention.

FIG. 1A shows the same type of solution in principle as in FIG. 1, but with certain design differences. In the first place, the design according to FIG. 1A has only one nonreturn valve 13B. It is namely entirely adequate to have one nonreturn valve only in the inlet part, i.e. before the pressure chamber 11. Another difference is that the intake duct 12 itself according to this embodiment also forms the restricting device 13A in the supply line. Furthermore, the adjusting piston 8 is provided with a flange part both at the bottom 8B and at the top 8C. The sleeve-shaped body 70 is adapted to this design by extending the entire way down trough the recess in the piston 1 and has in a middle section an inwardly directed flange-type part 70A. The pressure space 11 is thus formed between this flange-shaped part 70A and the upper flange 8C of the adjusting piston. Located in the flange-shaped part 70A are connecting ducts 14C that connect the pressure chamber 11 to an outlet chamber 14D, which communicates directly with the outlet 14A. The outlet 14A is also provided with a duct that contains the restricting device. A duct 60 between the seals 9B and the inside of the piston makes it possible for surplus oil to be drained back. FIG. 1B shows in a perspective from above a sleeve-shaped body 70 according to the execution used in FIG. 1A. It is evident that the body 70 is provided with a plurality of vertical ducts 14C that communicate that communication is permitted between the pressure chamber 11 and the outlet chamber 14D.

Figure 2:
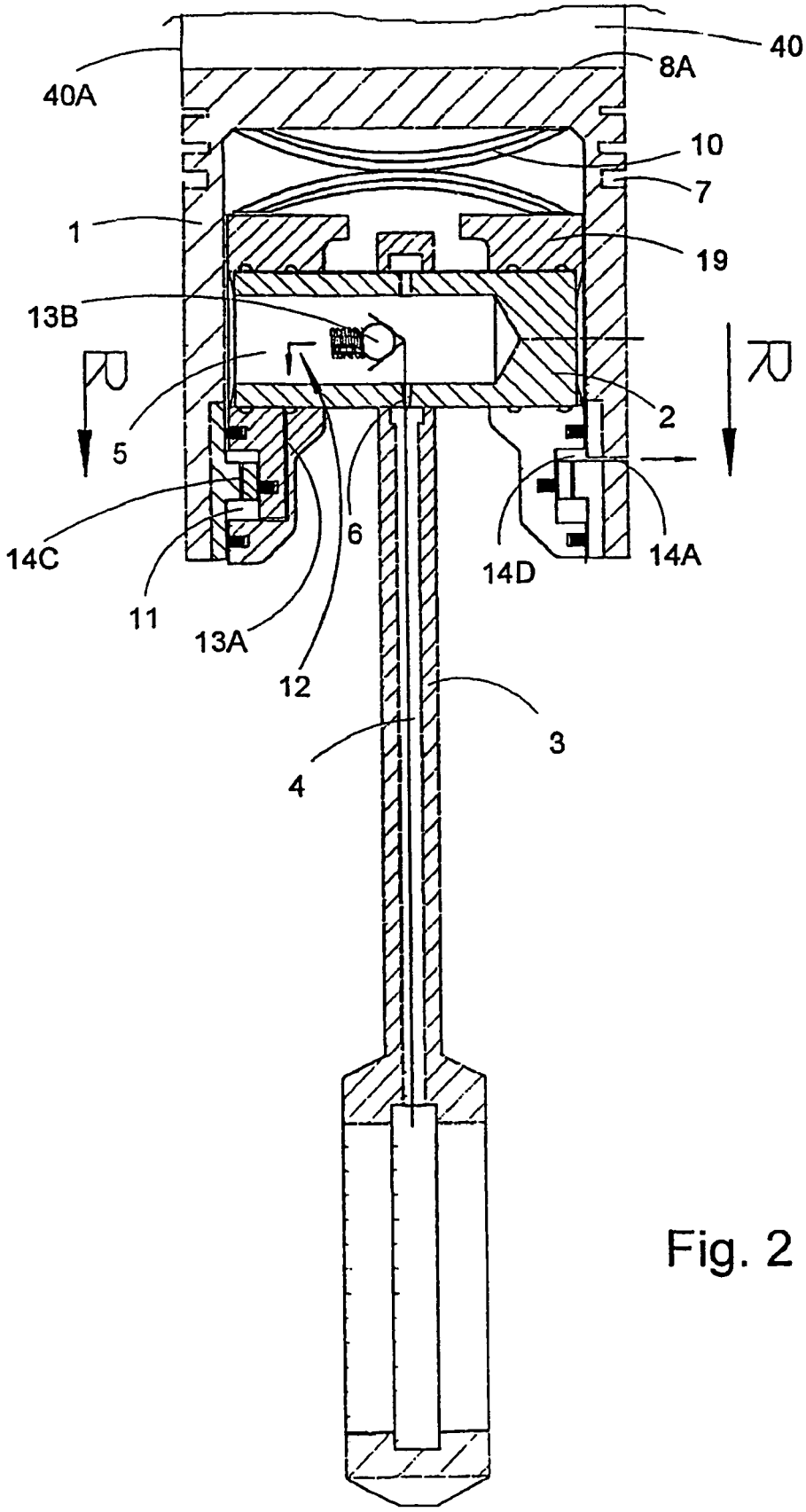

FIG. 2 shows a further embodiment of the present invention, in which the same reference symbols as occur in FIG. 1 and FIG. 1A apply to the same elements.

An important difference between the embodiments is that according to FIG. 2 the entire piston's casing 1 is disposed movably in relation to the piston pin 2. Furthermore, the pressure chamber 11 has been moved to a part below the piston pin 2, but is otherwise constructed according to the principles shown in FIG. 1A. A further difference is that instead of a helical spring 10, cup springs are used here.

The present invention thus functions in the manner that the momentary pressure of combustion in the engine acts downwards on the adjusting piston 8 during a very short period of the engine's working cycle. The up and down movement of the adjusting piston 8 is damped by means of the oil, thanks to the restricting devices 13A, 14A for the inflow and outflow respectively to/from the pressure chamber 11.

For the remainder of the time, the mechanical spring strives to cause the adjusting piston to rise. As the spring operates for a long period relative to the actual combustion process, it is sufficient for the spring force to be 5–20 N/cm$^2$ (where the intended surface is the entire upper surface of the piston) in the top dead centre, i.e. in the least compressed position of the spring.

A functional state of equilibrium is hereby achieved after a number of working cycles (strong pendulum motions that produce large losses are eliminated). The adjusting piston 8 will automatically adjust itself to the position that corresponds to the engine's filling level. (An increased filling level influences the pressure against the piston surface for the specific working cycle in contrast to an increased engine speed, for example.) This means that the adjusting piston 8 only changes its position in the event of a varied quantity of the fuel-air mixture admitted for the specific working cycle=filling level.

Due to the continuous motion of the adjusting piston 8 up and down, the risk of the sides of the adjusting piston wall drying out (sticking) is lessened. This so-called drying out is a known problem, with increased wear in the dried out area being the result.

Figure 3:
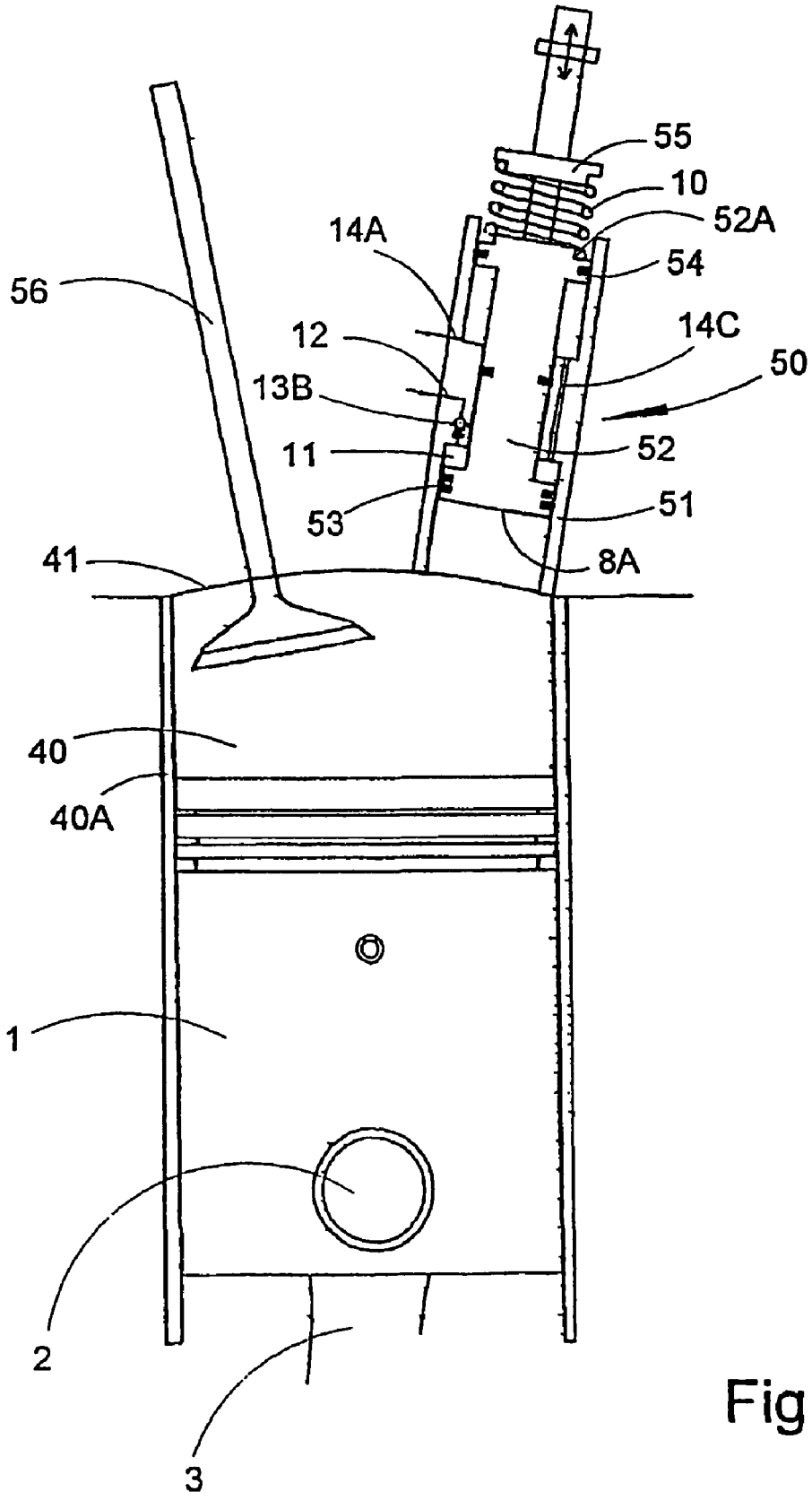

FIG. 3 shows a further embodiment of a combustion space according to the invention. According to this execution, the piston 1 consists of a conventional arrangement. Thus there is no movable part on the piston 1 or any pressure duct 4 inside the connecting rod 3. Instead, an adjusting device 50 comprising a cylindrical casing 51, inside which a separate piston 52 is disposed movably and has a lower surface 8A that delimits a part of the combustion space 40, is located at the upper end of the combustion chamber 40, i.e. in the cylinder head 41. The delimiting surface 8A is movable by means of the piston 52, which is displaceable within said casing 51. The adjusting piston 52 is provided with seals 53 that facilitate the creation of a pressure chamber 11, which is connected to an inlet 12 for the supply of hydraulic oil via a nonreturn valve 13B. The adjusting piston 52 is provided at its upper end with a further seal 54 that prevents oil from leaking out of the casing 51 at the top. The pressure chamber 11 communicates via a restricting device 14A with an outlet 14, through which hydraulic oil can be evacuated from the pressure chamber 11. A compression spring 10 is disposed between a fixed stop 55 and an upper end 52A of the adjusting piston, so that the compression spring 10 strives continuously to displace the adjusting piston 52 downwards towards the combustion chamber 40. The execution functions wholly in accordance with the principles that have been described above in FIGS. 1 and 2, with the exception that the adjusting device does not follow the piston 1 in its movement.

As stated above, the position of the adjusting piston 8 is adjusted automatically depending on the work effort of the engine. It is perceived that this positional/equilibrium state is dependent on the opposing force exerted by the spring 10. The adjusting piston 8 tolerates a certain reduction in oil pressure without risk of engine damage.

In a simulated example of an engine according to the invention, pistons are used with a diameter of 80 mm for an Otto engine, i.e. a piston surface of approx. 50 $cm^2$. The compression ratio is then between 1:8 and 1:17. Depending on various contributory variables, the optimum spring force in the starting position/top dead centre is then at least 400 N and in the maximum compressed position in certain cases up to 4000 N to obtain the desired power. The damping requirement, i.e. the restricting effect, was kept largely constant in the example studied at 200 kNs/m. Lower damping gives swifter positioning and higher damping gives smaller vibration losses. Great advantages can be obtained with an engine equipped according to the invention. By increasing the compression ratio from 1:10.5 to 1:18, the power in a simulated 1.6 liter engine increased under partial load from 8.2 to 11.0 kW.

If starting out from a small engine with turbocharging, very good performance can be obtained with variable compression, i.e. a high torque and a fuel saving of 30–40%. By only increasing the compression ratio under partial load, a fuel saving of 10–15% is achieved.

The invention is not restricted to the embodiments shown but can be varied in different ways within the scope of the claims. It is perceived amongst other things that springs of different types can be used and that these can be optimized in different ways in different applications. Furthermore, it is perceived that the opposing force from the spring 10 can advantageously be made adjustable in certain applications. According to the execution in FIG. 5, this is achieved simply by making the stop 55 movable/adjustable, e.g. by means of a servomotor or hydraulic control valve. Alternatively by using a pneumatic spring device. Adjustment is best controlled by means of a computer on the basis of the desired control data, e.g. load, speed, emission values, air temperature, engine temperature, etc., due to which the state of equilibrium can be adapted momentarily.

The invention claimed is:

1. A combustion engine comprising at least one combustion chamber, which is delimited at one end by a head and delimited at a second end by a piston, the piston being arranged on a connecting rod by means of a piston pin, the piston including a first body portion that is fixed in relation to the piston pin and a second body portion with a delimiting surface that is movable in relation to the piston pin and facilitates a variable volume in said combustion chamber, a compression spring, which spring urges said movable surface with a spring force in the direction of the combustion chamber, a pressure chamber that can be supplied with hydraulic oil from a pressure source via a feed duct, which pressure chamber interacts with the movement of said moveable delimiting surface with the aim of being able to adjust the size of the combustion chamber depending on the combustion pressure, wherein said pressure chamber communicates with an inlet duct that always facilitates replenishment of hydraulic oil from said pressure source to said pressure chamber when the pressure in the pressure chamber falls below the pressure in the feed duct, and wherein said pressure chamber communicates with an outlet chamber, wherein said outlet chamber communicates with at least one outlet including a restricting device that continuously facilitates a flow of hydraulic oil out of the pressure chamber if the pressure in the chamber exceeds the pressure in said outlet chamber, and wherein a sleeve-shaped part is fixedly attached to one of said body portions, which sleeve-shaped part comprises a flange-shaped part, said pressure chamber and said outlet chamber being provided on a respective side of said flange-shaped part, and wherein said flange-shaped part is provided with at least one vertical duct that provides for communication between the pressure chamber and the outlet chamber, so that pressurized damping of the movement of said second body portion with said delimiting surface is obtained during operation.

2. The combustion engine according to claim 1, wherein said outlet chamber is provided with at least one nonreturn valve.

3. The combustion engine according to claim 2, wherein said inlet feed duct is provided with at least one nonreturn valve.

4. The combustion engine according to claim 1, wherein the spring force is achieved by a mechanical spring, which in the starting position/top dead centre exerts a spring force in the range of 5–20 N per $cm^2$ piston surface.

5. The combustion engine according to claim 1, wherein said movable delimiting surface is provided on said piston.

6. The combustion engine according to claim 5, wherein said movable delimiting surface only forms one part of the upper surface of the piston.

7. The combustion engine according to claim 6, further comprising a movable body arranged in a recess in the surface of the piston facing the combustion chamber, which body has said movable delimiting surface.

8. The combustion engine according to claim 2, wherein the restricting device consists of one or more cavities that provide damping of between 2–20 kNs/m per $cm^2$ of piston surface.

9. The combustion engine according to claim 3, wherein said movable delimiting surface is disposed on the head.

10. The combustion engine according to claim 4, wherein said spring in the maximum compressed position exerts a spring force in the range of 40–140 N per $cm^2$ of piston surface.

11. A combustion engine comprising:

at least one combustion chamber, which is delimited at a first end by a head and delimited at a second end by a piston;

the piston being arranged on a connecting rod by means of a piston pin, the piston including a first body portion that is fixed in relation to the piston pin and a second body portion with a delimiting surface that is movable in relation to the piston pin and which facilitates a variable volume in the combustion chamber, a compression spring, which spring urges the movable surface with a spring force in the direction of the combustion chamber;

a pressure chamber dimensioned and configured to be supplied with hydraulic fluid from a pressure source via a feed duct, which pressure chamber interacts with the movement of the moveable delimiting surface whereby the size of the combustion chamber can be adjusted depending on the combustion pressure, wherein the pressure chamber communicates with an inlet duct that facilitates replenishment of the hydraulic oil from the pressure source to the pressure chamber when the pressure in the pressure chamber falls below the pressure in the feed duct, and wherein the pressure chamber communicates with an outlet chamber, wherein the outlet chamber communicates with at least one outlet including a restricting device that continuously facilitates a flow of hydraulic fluid out of the pressure chamber if the pressure in the chamber exceeds the pressure in the outlet chamber, and further wherein a sleeve-shaped part is fixedly attached to one of said body portions, which sleeve-shaped part comprises a flange-shaped part, said pressure chamber and said outlet chamber being provided on a respective side of said flange-shaped part, and wherein said flange-shaped part is provided with at least one vertical duct that provides for communication between the pressure chamber and the outlet chamber, and wherein the outlet chamber comprises at least one nonreturn valve, whereby damping of the movement of the body with the delimiting surface is obtained during operation.

12. A combustion engine according to claim 11, wherein the spring force is achieved by a mechanical spring, which in a starting position/top dead centre, exerts a spring force in a range of from about 5–20 N per $cm^2$ piston surface.

13. A combustion engine according to claim 11, wherein the spring force is achieved by a mechanical spring, which in a starting position/top dead centre, exerts a spring force in a range of from about 7–15 N per $cm^2$ piston surface.

14. A combustion engine according to claim 11, wherein the delimiting surface is provided on the piston.

15. A combustion engine comprising:

at least one combustion chamber, which is delimited at a first end by a head and delimited at a second end by a piston;

the piston being arranged on a connecting rod by means of a piston pin, the piston including a first body portion that is fixed in relation to the piston pin and a second body portion with a delimiting surface that is movable in relation to the piston pin and which facilitates a variable volume in the combustion chamber, a compression spring, which spring urges the movable surface with a spring force in the direction of the combustion chamber;

a pressure chamber dimensioned and configured to be supplied with hydraulic fluid from a pressure source via a feed duct provided with at least one nonreturn valve, which pressure chamber interacts with the movement of the moveable delimiting surface whereby the size of the combustion chamber can be adjusted depending on the combustion pressure, wherein the pressure chamber communicates with an inlet duct that facilitates replenishment of the hydraulic oil from the pressure source to the pressure chamber when the pressure in the pressure chamber falls below the pressure in the feed duct, and wherein the pressure chamber communicates with an outlet chamber, wherein the outlet chamber communicates with at least one restricting device that continuously facilitates a flow of hydraulic fluid out of the pressure chamber if the pressure in the chamber exceeds the pressure in the outlet, wherein a sleeve-shaped part is fixedly attached to one of said body portions, which sleeve-shaped part comprises a flange-shaped part, said pressure chamber and said outlet chamber being provided on a respective side of said flange-shaped part, and wherein said flange-shaped part is provided with at least one vertical duct that provides for communication between the pressure chamber and the outlet chamber, and and further wherein the outlet chamber is provided with at least one nonreturn valve, whereby damping of the movement of the second body with the delimiting surface is obtained during operation.

16. A combustion engine according to claim 15, wherein the spring force is achieved by a mechanical spring, which in a starting position/top dead centre, exerts a spring force in a range of from about 5–20 N per $cm^2$ piston surface.

17. A combustion engine according to claim 15, wherein the spring force is achieved by a mechanical spring, which in a starting position/top dead centre, exerts a spring force in a range of from about 7–15 N per $cm^2$ piston surface.

18. A combustion engine according to claim 15, wherein the delimiting surface is provided on the piston.

19. A combustion engine according to claim 1, wherein the spring force is achieved by a mechanical spring, which in the starting position/top dead centre exerts a spring force in the range of 7–15 $N/cm^2$.

20. A combustion engine according to claim 2, wherein the restricting device consists of one or more cavities that provide damping of between 5–15 kNs/m per $cm^2$ of piston surface.

21. A combustion engine according to claim 4, wherein said spring in the maximum compressed position exerts a spring force in the range of 60–120 $N/cm^2$ of piston surface.

* * * * *